United States Patent [19]

Olsson

[11] Patent Number: 4,582,376

[45] Date of Patent: Apr. 15, 1986

[54] SHORTING BAR HAVING WIPING ACTION

[75] Inventor: Billy E. Olsson, New Cumberland, Pa.

[73] Assignee: AMP Incorporated, Harrisburg, Pa.

[21] Appl. No.: 597,862

[22] Filed: Apr. 9, 1984

[51] Int. Cl.[4] ..... H01R 13/70

[52] U.S. Cl. ..... 339/19; 200/51.1

[58] Field of Search ..... 339/19, 18 R, 18 B, 339/18 C, 18 P, 222; 200/51.1, 51.09

[56] References Cited

U.S. PATENT DOCUMENTS

| | | | |
|---|---|---|---|
| 3,860,318 | 1/1975 | Reavis, Jr. et al. | 339/99 |
| 4,152,041 | 5/1979 | Hollyday et al. | 339/147 P |
| 4,186,984 | 2/1980 | Reavis, Jr. et al. | 339/103 R |
| 4,224,486 | 9/1980 | Zimmerman, Jr. et al. | 200/51.1 |
| 4,274,691 | 6/1981 | Abernethy et al. | 339/19 |
| 4,330,164 | 5/1982 | Pittman et al. | 339/49 R |
| 4,382,156 | 5/1983 | Jodoin | 174/72 B |
| 4,449,778 | 5/1984 | Lane | 339/143 R |
| 4,457,570 | 7/1984 | Bogese, II | 339/19 |
| 4,501,459 | 2/1985 | Chandler et al. | 339/48 |

*Primary Examiner*—Neil Abrams

*Attorney, Agent, or Firm*—Russell J. Egan; Robert W. Pitts

[57] ABSTRACT

A shorting bar assembly is mounted in an electrical connector housing so as to selectively short at least pairs of terminals thereof. Each shorting bar assembly has at least one shorting bar member having at least two integral depending tines extending at an angle with respect to a body of the shorting bar and to the longitudinal axis of an associated terminal. In an unmated condition of the connector the free end of the respective terminal engages the shorting bar tine in a loaded condition. During mating or unmating of the connector, the resilient portion of the terminal is deflected so as to cause a relative wiping movement between the free end of the terminal and the tine of the shorting bar moving between loaded and unloaded conditions.

5 Claims, 8 Drawing Figures

SHORTING BAR HAVING WIPING ACTION

The present invention relates to a shorting bar assembly which provides a wiping action during mating and unmating of an associated electrical connector.

There are many times in the electrical industry when it is desirable to have a connector which will short selected terminals in an unmated condition. An example of such an electrical connector may be found in U.S. patent application Ser. Nos. 452,170 now abandonded and 452,171 U.S. Pat. No. 4,449,778, both filed Dec. 22, 1982, assigned to the common assignee, and the disclosures of which are incorporated herein by reference. The former of these applications is particularly directed towards a shorting system. However, there is a problem in this type of electrical connector in that, because of environmental conditions, corrosion may occur on the shorting element so that incomplete or inconsistent shorting takes place. It is the object of the present invention to overcome the deficiency of the prior art by providing an electrical connector in which the shorting member has a wiping action to assure a positive shorting contact is effected.

The present invention concerns a shorting assembly for use in a multi-terminal electrical connector, which shorting assembly will selectively contact respective groups of terminals to effect shorting thereof. The shorting assembly includes at least one metal shorting bar having an elongated body portion with at least two resilient tines depending therefrom at an angle with respect to the plane of the body portion and to the longitudinal axis of associate terminals. The free end of each tine engages a resilient portion of an associated terminal under load in an unmated condition of the connector. Mating of the connector causes deflection of the resilient portion of the terminal, unloading and opening of the shorting contact with a resultant wiping action.

The present invention will now be described by way of example with reference to the accompanying drawings in which.

Figure 1:
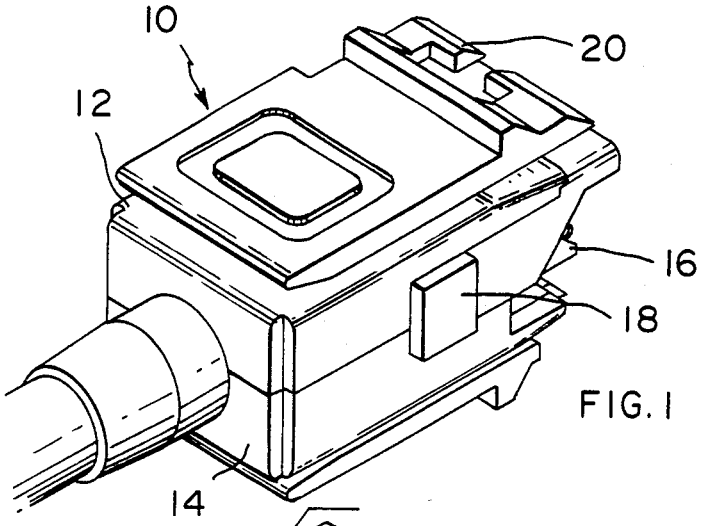
FIG. 1 is a perspective view of an electrical connector of the type which can utilize the present invention.

Referring to FIG. 1, an electrical connector 10 of hermaphroditic construction is illustrated as representative of the type of connector which could embody the present invention. The connector 10 has a pair of mating covers 12, 14 of insulating material enclosing a terminal carrying member 16 and including polarizing means 18 and latching means 20.

Figure 2:
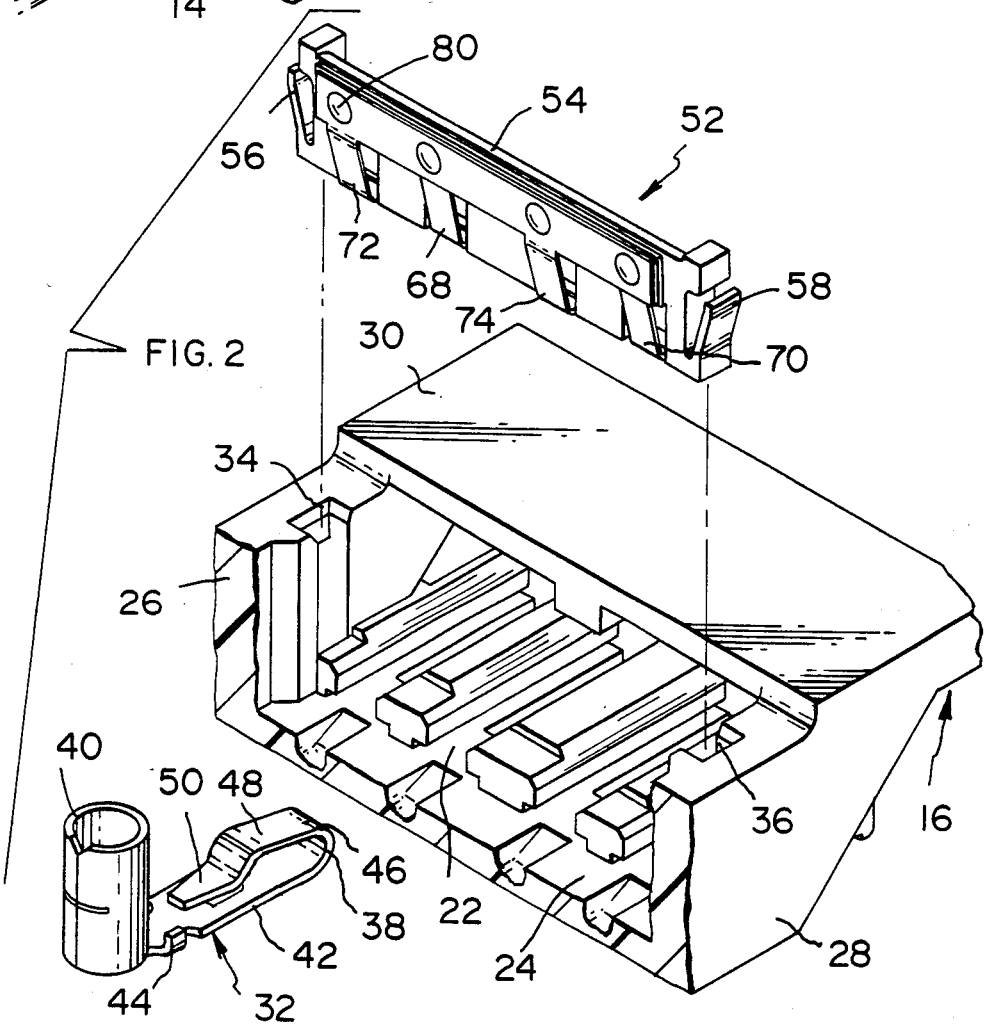
FIG. 2 is an exploded perspective view of a terminal carrying member of the electrical connector of FIG. 1 including a shorting bar assembly according to the present invention.
Figure 3:
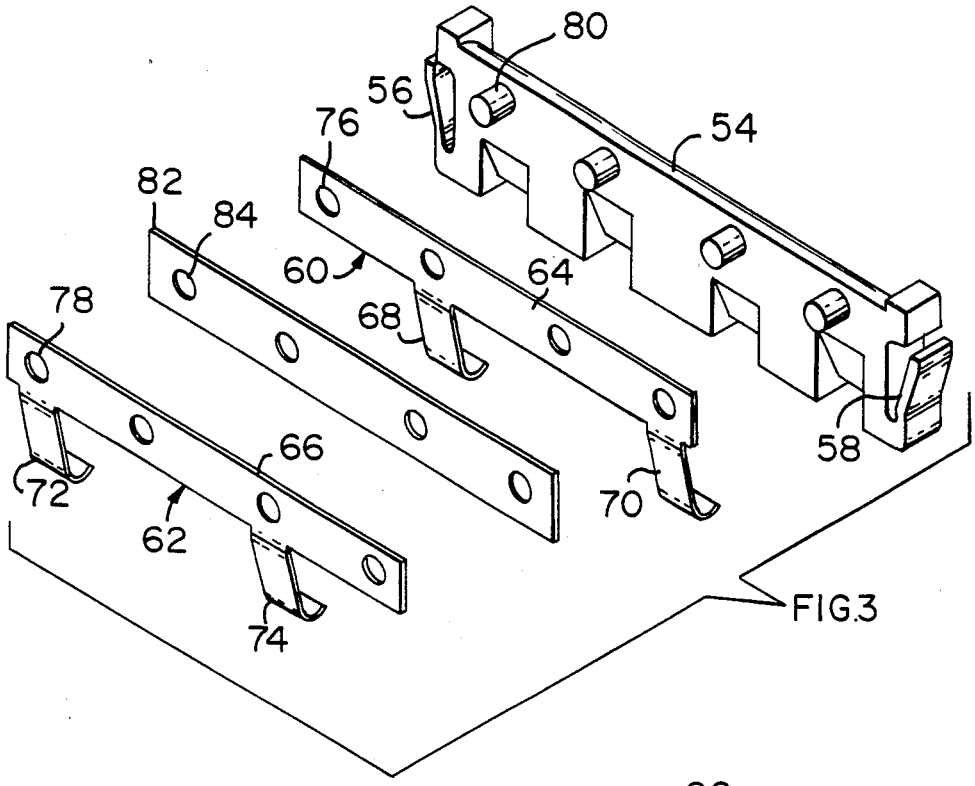
FIG. 3 is an exploded perspective view of the subject shorting bar assembly.

FIG. 2 shows the terminal carrying member 16 which is a generally rectangular member of rigid insulative material defining a plurality of parallel spaced terminal passages 22 in an area enclosed by integral bottom wall 24, spaced parallel side walls 26, 28, and top wall 30. The bottom wall 24 is profiled to receive the respective terminals 32 therein. Each of the side walls 26, 28 is provided with profiled groove 34, 36 respectively, extending normal to the bottom wall 24. Each terminal 32 is stamped and formed from metal stock and has a mating portion 38 and a conductor engaging portion 40, here represented as a slotted wire barrel of known configuration. The mating portion 38 has an elongated body 42 including mounting tines 44 and a cantilever beam portion 46 folded back upon itself with a surface 48 thereof forming the contact area and the free end 50 forming a shorting bar engaging portion.

The shorting bar assembly 52 is formed by an elongated insulative member 54 having latching means 56, 58 on the ends thereof and at least one shorting bar 60, 62 fixedly attached thereto. Each at least one shorting bar 60, 62 comprises a metal body portion 64, 66 having at least two tines 68, 70, 72, 74 depending therefrom at an angle with respective to the plane of the body portion 64, 66 and the longitudinal axis of a respective terminal 32. The shorting bars 60, 62 have been here shown with apertures 76, 78 through which pegs 80 extend and which are heat-staked to secure the bars 60, 62 to the member 54. Clearly other mounting means, such as force fit into a slot, and/or latching barbs, could likewise be used. The shorting bars 60, 62 are separated from each other by insulative member 82, which is provided with mounting apertures 84.

Figure 4:
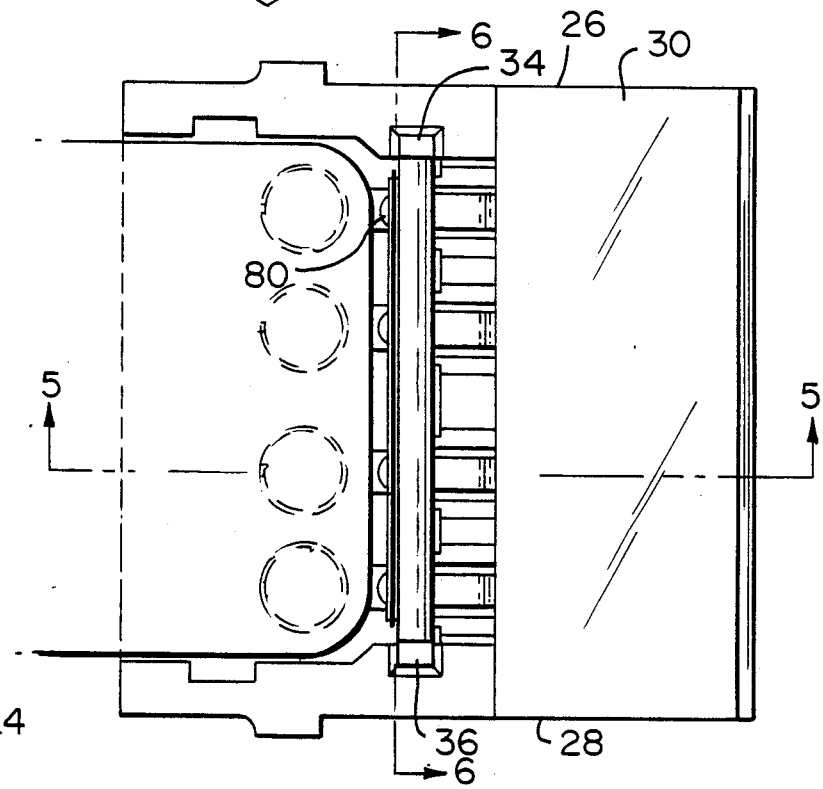
FIG. 4 is a plan view of the terminal carrying member of the electrical connector of FIG. 1 and the subject shorting bar assembly.
Figure 5:
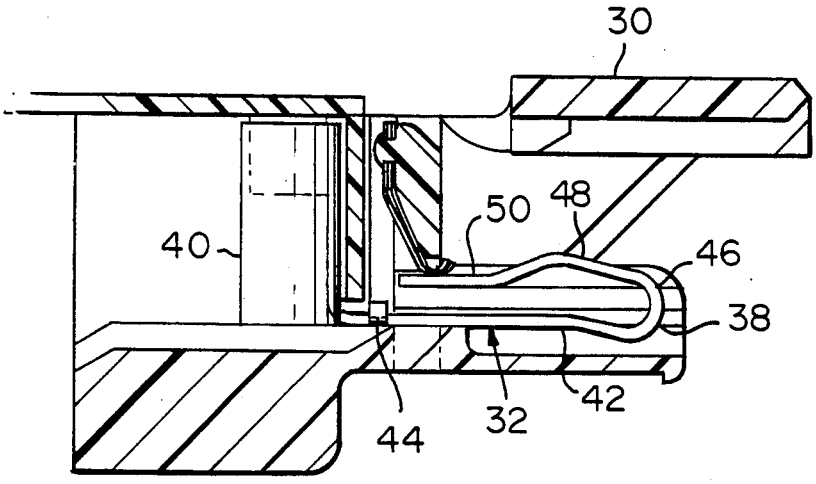
FIG. 5 is a section taken along line 5—5 of FIG. 4.
Figure 6:
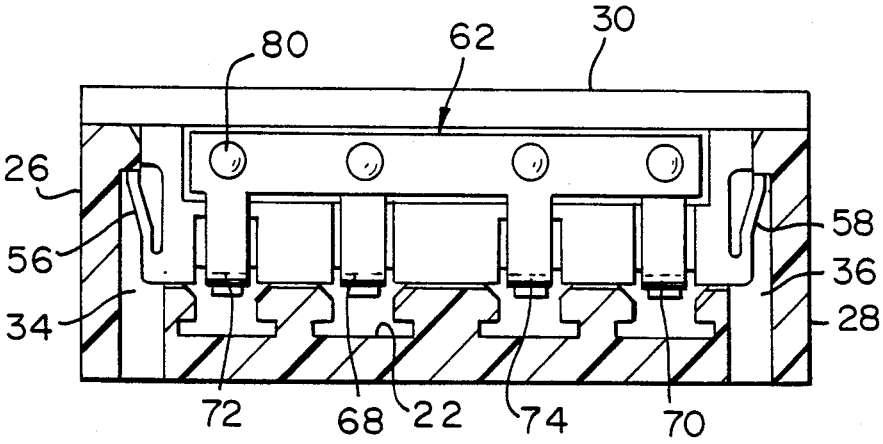
FIG. 6 is a section taken along line 6—6 of FIG. 4.
Figure 7:
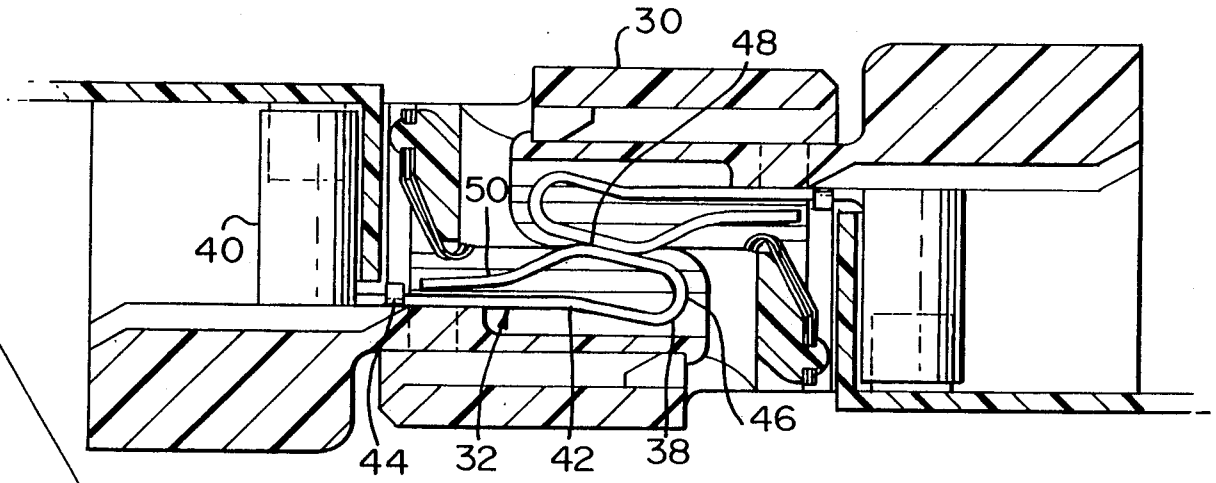
FIG. 7 is a section, similar to FIG. 5, showing a pair of connectors in a mated condition.
Figure 8:
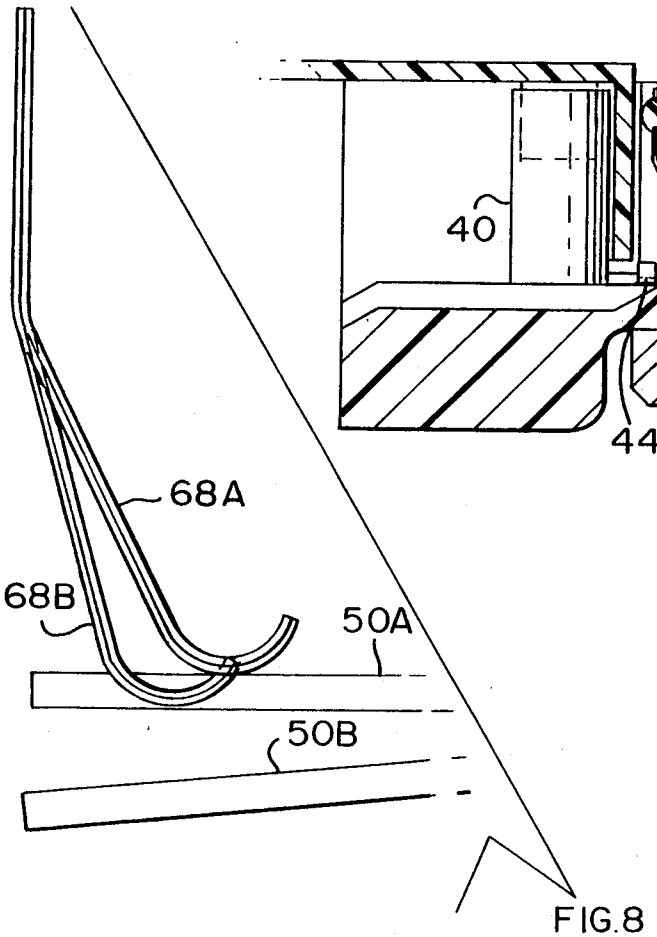
FIG. 8 is a schematic diagram illustrating the operational characteristic of the present invention.

It will be readily understood from FIGS. 2 and 4 that the present invention is assembled by first inserting the terminals 32 into their respective passages 22 with the terminals 32 being secured therein by engagement of the latches 44 in the passage walls. The shorting bar assembly 52 is then placed in the respective slots 34, 36 in the side walls 26, 28 and secured in place by the latching means 56, 58. This places the shorting bar tines 68, 70, 72, 74 into a loaded engagement with the free ends 50 of the respective terminals 32. This is the condition noted by reference numerals 68A and 50A in FIG. 8. Mating of the connector members, as shown in FIG. 7, causes the free end 50 of the respective terminal 32 to be deflected downwardly allowing the shorting bar tines 68, 70, 72, 74 to move from a loaded to an unloaded condition as noted by reference numerals 68B and 50B in FIG. 8. During this combined movement there is a wipe of the tine across the surface of the free end 50 of the terminal 32. The loaded, shorting condition will also be understood from a comparison of FIG. 5 to the unloaded, non-shorting, mated condition of FIG. 7. The movement of the resilient depending tines 68, 70, 72, and 74 between relative positions 68A and 68B as shown in FIG. 8 results in a relative wiping action, both during movement of the tines and terminals from the loaded, unmated configuration to the unloaded mated configuration and also during movement from the mated unloaded configuration to the unmated, loaded configuration.

The present invention may be utilized in many embodiments and is not to be considered as being restricted by the single embodiment illustrated in a connector having only four terminals which are shorted in pairs. Any number of terminals in any combination of groups could be shorted in similar fashion. Also the amount of wipe could be controlled by the length of the tines and deflection of the terminal. Further, the tines could be plated with any of the known plating materials.

I claim:

1. In an electrical connector having a terminal carrying member defining a plurality of spaced terminal passages, a like plurality of terminals each mounted in a respective passage and having a matin portion with a resilient free end flexed during mating and unmating of said connector, a shorting bar assembly to selectively short at least pairs of said terminals, said shorting bar assembly comprising at least one conductive shorting bar member secured transversely of the teminals, each said at least one shorting bar member having a body portion with at least two integral depending tines extending at an angle with respect to the plane of said body and to the longitudinal axis of a respective terminal to engage a free end thereof in a loaded condition in an unmated condition of said connector, said terminal being deflected upon mating of said connector to move out of contact with said tine, said movement causing relative wiping action between said terminal and said tine.

2. The electrical connector according to claim 1 further comprising:

an insulative member mounted transversely in said terminal carrying member, said at least one shorting bar secured to said insulative member.

3. The electrical connector according to claim 2 further comprising:

plural said conductive shorting bars; and a further insulative member between and isolating each said shorting bar.

4. The electrical connector according to claim 1 further comprising:

a conductive plating on each said tine.

5. In an electrical connector having a terminal carrying member defining a plurality of spaced terminal passages, a like plurality of terminals each mounted in a respective passage and having a mating portion with a resilient free end flexed during mating and unmating of said connector, a shorting bar assembly to selectively short at least pairs of said terminals, said shorting bar assembly comprising at least one conductive shorting bar member secured transversely of the terminals, each said at least one shorting bar member having a body portion with at least two integral depending tines engaging respective terminals in a loaded condition in an unmated condition of said connector, said terminal being deflected upon mating of said connector to move out of contact with said tine; characterized in that each depending tine extends at an angle with respect to the plane of said body and to the longitudinal axis of a respective terminal to enage a free end thereof, whereby a wiping action occurs during relative movement between the terminal and a respective tine.

* * * * *